United States Patent [19]

Thiruvengadam et al.

[11] 4,127,332

[45] Nov. 28, 1978

[54] HOMOGENIZING METHOD AND APPARATUS

[75] Inventors: Alagu P. Thiruvengadam, Columbia; Ambrose A. Hochrein, Jr., Olney, both of Md.

[73] Assignee: Daedalean Associates, Inc., Woodbine, Md.

[21] Appl. No.: 743,490

[22] Filed: Nov. 19, 1976

[51] Int. Cl.[2] ..... B01F 5/02

[52] U.S. Cl. ..... 366/131; 366/176; 252/359 A; 252/359 D

[58] Field of Search ..... 259/4 R, DIG. 30, 95; 138/42, 43, 44; 251/124, 127; 23/271 R; 159/2 E

[56] References Cited

U.S. PATENT DOCUMENTS

| | | | |
|---|---|---|---|
| 1,986,600 | 1/1935 | Pigatt | 251/124 |
| 2,323,567 | 7/1943 | Rannsheck | 138/42 |
| 2,835,481 | 5/1958 | Cox | 259/95 |
| 3,120,377 | 2/1964 | Lipshultz | 259/95 |
| 3,271,304 | 9/1966 | Valdespino | 259/95 |
| 3,545,492 | 12/1970 | Scheid | 138/44 |
| 3,583,681 | 6/1971 | Brown | 259/95 |
| 3,610,286 | 10/1971 | McGowen | 138/44 |
| 3,628,918 | 12/1971 | Beak | 259/4 R |
| 3,713,699 | 1/1973 | Johnson | 299/17 |
| 3,744,762 | 7/1973 | Schlicht | 259/4 R |
| 3,750,710 | 8/1973 | Hayner | 138/44 |
| 3,782,695 | 1/1974 | Sandiford | 259/95 |
| 3,937,945 | 2/1976 | Agasta | 259/DIG. 30 |

*Primary Examiner*—Herbert F. Ross
*Attorney, Agent, or Firm*—Burns, Doane, Swecker & Mathis

[57] ABSTRACT

A method and apparatus are disclosed for the homogenization of a multicomponent stream including a liquid and a substantially insoluble component, which may be either a liquid or a finely divided solid. The homogenization process is effected by passing the multicomponent, fluid stream through a turbulent shear layer having a substantial velocity gradient there-across and designed such that turbulent vortical eddies generate a cavitating flow regime. The cavitating flow regime allows the generation of vapor bubbles which move downstream into a region of pressure and violently collapse. The violent bubble collapse creates intense pressure pulses which cause the intimate intermixing of the liquid and the substantially insoluble component such that the effluent, a resulting emulsion, has an exceptionally long separation half-life with a very high emulsification coefficient. When the insoluble component is a particulate solid, the collapse of the cavitation bubbles further subdivides those particles such that the effluent is a colloidal suspension. The turbulent shear layer may be effected with a homogenizing unit having a relatively small diameter sharp-edged orifice. One or more suitable premixers having helical vanes therein may be positioned upstream of the homogenizing unit such that the multicomponent flow is not stratified and efficiency of the homogenization process is enhanced.

28 Claims, 11 Drawing Figures

Fig. 1
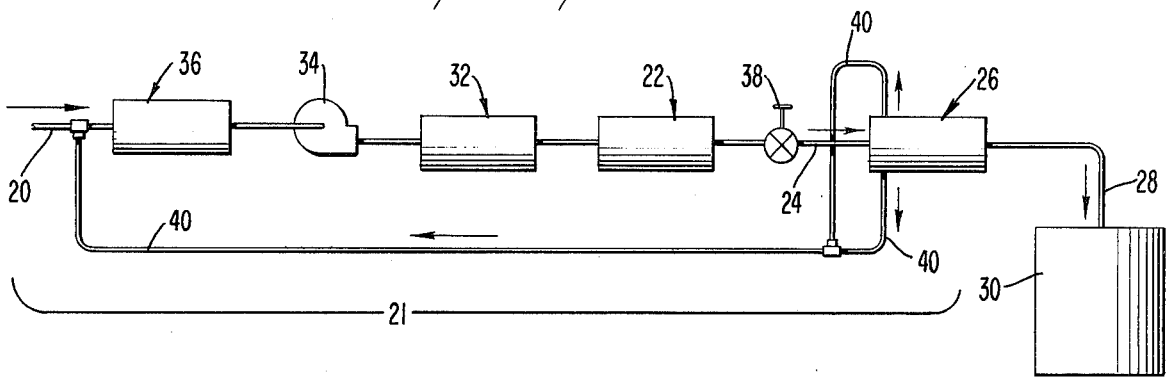
Fig. 2
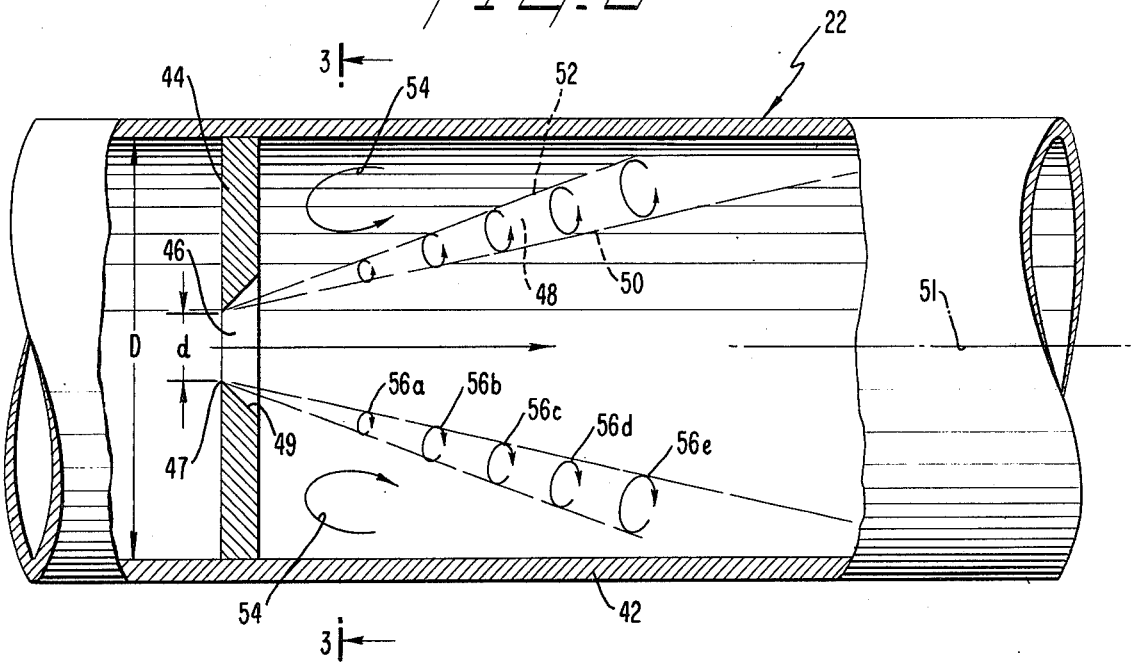
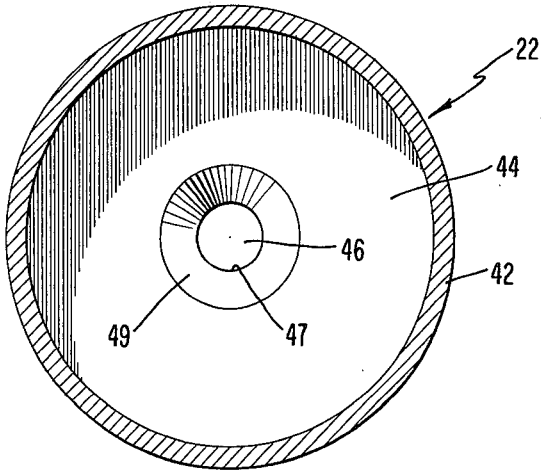
Fig. 3

Fig. 7
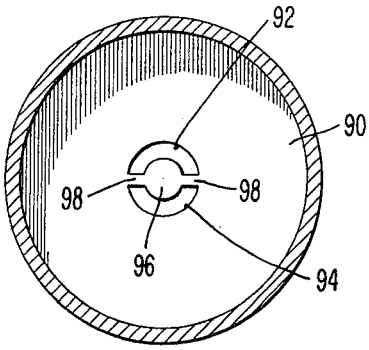
Fig. 8
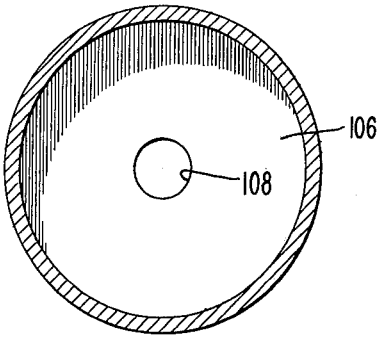
Fig. 9
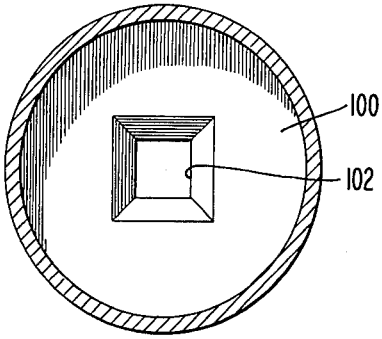
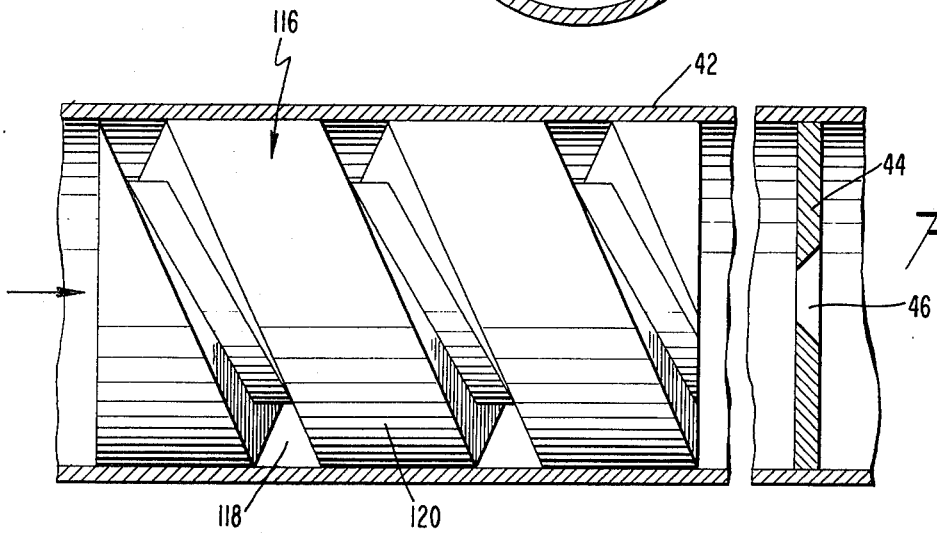
Fig. 10
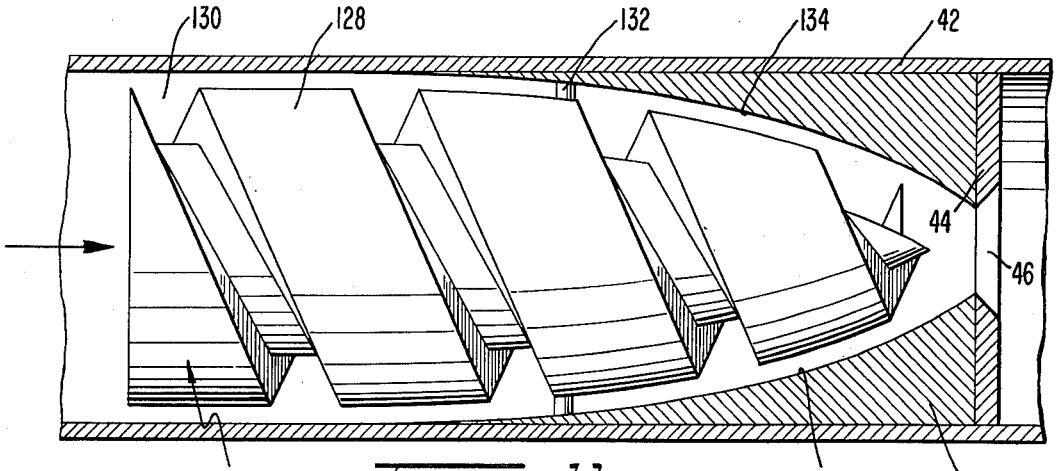
Fig. 11

HOMOGENIZING METHOD AND APPARATUS

BACKGROUND OF THE INVENTION

This invention relates generally to a method and apparatus for homogenization of a liquid stream and a substantially insoluble component. More particularly, this invention is concerned with a method and apparatus for homogenization of a fluid stream and a substantially insoluble component by the use of cavitating flow.

In the past, various mechanical, hydromechanical and hydrodynamic devices have been employed for the creation of emulsions and colloidal suspensions of a fluid component with a second but substantially insoluble fluid component or a finely divided particulate solid, respectively. A particular problem with the known devices relates to the stability of the resulting emulsion or colloidal suspension. Very frequently, constituents of an emulsion or colloid begin to separate or settle within a short period of time, on the order of a few seconds to a minute, so that usefulness of the emulsion or colloidal suspension is severely limited within a time framework. Moreover, storage for any useful period of time has been essentially impossible because of the separation problem.

Another shortcoming of known devices is the ability to handle large volumetric flow rates, on the order of 100 gallons per hour, for example, with high homogenization efficiency. Moreover, the comparatively inefficient known devices are not suited to on-line applications where there must be a substantially continuous supply of homogenized fluid.

Over the years, various types of homogenizing devices have been made. An example of one such device is disclosed in U.S. Pat. No. 3,744,762 issued July 10, 1973 by W. Schlicht. This device includes an annular gap with radially spaced-apart grooves which cooperate with fluid passing through the channel to create a plurality of cavitation zones in the annular gaps. The annular gap itself is defined by two closely spaced-apart members.

In another known homogenizing device, U.S. Pat. No. 3,937,445 issued Feb. 10, 1976 to V. Agosta, a venturi is designed such that the static pressure of fluid flowing through the venturi throat is reduced below the fluid vapor pressure so that cavitation bubbles are propagated in the throat of the venturi and adjacent to the walls thereof.

In the known cavitating homogenization devices and processes, cavitation occurs adjacent to a solid surface of the apparatus. This juxtaposition of a cavitating flow to a solid surface is quite deleterious to the structure of the apparatus itself; it has long been known in the design of hydrodynamic propellers and underwater bodies that the collapse of cavitation bubbles moving into a region of higher static pressure adjacent to a solid causes substantial damage to that solid surface. More particularly, rapidly reversing pressures on the order of 10,000 atmospheres have been attributed to the collapse of cavitation bubbles. Such reversing pressures in a flow adjacent a solid boundary often may result in erosion and ultimate fatigue failure of the adjacent solid surface.

Another particular difficulty with prior studies of cavitation is the fact that those studies are typically concerned with control or elimination of the cavitating flow regime and have not addressed the useful applications to which cavitation may be put. Thus, a typical approach in cavitation research in the past has been to obtain a low cavitation inception parameter which signals the onset of cavitation in a particular system. To the extent that earlier studies have addressed the manner in which cavitation is fostered, these studies have been concerned with supercavitating flows — those flows in which a spatially fixed bubble is generated in a dynamic fluid system at a wall.

Aside from the few known attempts at employing cavitation as an homogenization mechanism, there has been activity in using sonic vibration to effect the required intimate intermixing of a dispersed component in a continuous component. Sonic vibration, however, does not produce the pressure magnitudes associated with collapsing bubbles and is not a phenomenon which can be self-induced in a fluid dynamic system.

From the foregoing, it is seen that a need continues to exist for a truly effective homogenization process and apparatus which provides an emulsion or colloidal suspension having an extremely long separation half-life and which uses cavitation but avoids mechanically deleterious interaction with the homogenizing apparatus resulting from the collapse of cavitation bubbles.

OBJECTS AND SUMMARY OF THE INVENTION

It is, therefore, an object of the present invention to provide a process for homogenization of a liquid and a substantially insoluble component by generating a cavitating flow regime in a turbulent velocity shear layer.

Another object of the present invention is to provide an apparatus for homogenizing a liquid and a substantially insoluble component which apparatus includes an orifice opening operable to establish a cavitating flow that is spaced from solid boundaries of the apparatus.

A further object of the present invention is to provide a method and apparatus for homogenizing a multicomponent flow to produce a separation half-life having a substantially improved magnitude.

Still another object of the present invention is to provide an homogenization apparatus, utilizing cavitation as the homogenizing mechanism, that maximizes bubble collapse intensity characterized by bubble size, frequency, density and collapse pressure so as to improve homogenization coefficient.

A still further object of this invention is to minimize power requirements of homogenization apparatus by employing comparatively low pumping pressures for the liquid stream.

The above, and many other objects of the present invention, are satisfied by a process in which a multicomponent stream including a liquid and at least one insoluble component is fed into an homogenizing apparatus in which a cavitating free turbulent velocity shear layer is developed. This cavitating free turbulent shear layer is a flow regime in which vapor bubbles form, expand, contract, and ultimately collapse. By subsequently exposing the free turbulent shear layer to a sufficiently high downstream pressure, the bubbles collapse violently and cause very high pressure shocks which cause intimate intermixing of the multicomponent stream. As a result, a homogenized effluent of liquid and the insoluble component is generated which has a substantially improved separation half-life.

The free turbulent velocity shear layer may be created in a multicomponent stream by an homogenizing apparatus having a suitable orifice plate assembly positioned tranversely of a conduit and provided with an opening through which the stream flows with a high velocity. In this manner, the velocity shear layer is passively generated in that no externally applied forces are required. Moreover, the zone of cavitation in the free turbulent shear layer is spaced from the solid boundaries of the conduit and, therefore, does not interact with and precipitate mechanical erosion or failure of the solid boundaries.

To improve the operating efficiency of the homogenization apparatus, the liquid and the insoluble component may be premixed in a spiral mixer positioned upstream of the homogenizing apparatus. In this manner, coarse mixing is effected by the mixer to eliminate stratification of the stream.

The homogenized effluent of the process and the apparatus may subsequently be conducted to a mass flow rate averaging holding tank from which the effluent may be withdrawn at a time-wise unsteady flow rate for use. In this manner, the volumetric flow rate of effluent into the holding tank may be sized in relation to the capacity of the tank such that the tank is filled at least one during one separation half-life. In addition, the capacity of the tank may be selected to accommodate the unsteady withdrawal rate so that a supply of homogenized effluent is always available. Accordingly, there is no opportunity for the homogenized effluent to remain in the holding tank beyond the separation half-life of the material and the quality of homogenized effluent is assured.

The homogenization apparatus may also be provided with a recirculation conduit extending from the holding tank to a location upstream of the orifice assembly. The recirculation conduit is effective to recirculate separated components of the emulsion through the homogenization apparatus and effect intimate mixing therebetween again where necessary or desirable.

In operation of the homogenizing process, a first pressure upstream of the apparatus is maintained within 10 to 100 times the pressure downstream of the homogenizing apparatus to develop the necessary flow turbulent velocity shear layer. Preferably, the upstream pressure is maintained at 25 times the downstream pressure so as to provide the most efficient homogenization of the multicomponent stream.

BRIEF DESCRIPTION OF THE DRAWINGS

The above and many other objects and advantages of the present invention will be apparent to those skilled in the art when this specification is read in conjunction with the attached drawings, wherein like reference numerals are applied to like elements, and wherein:

FIG. 1 is a schematic illustration of the process and apparatus according to the present invention;

FIG. 2 is an enlarged longitudinal cross-sectional view taken through a portion of the homogenizing apparatus of FIG. 1.

FIG. 3 is a view in transverse cross-section taken along the line 3—3 of FIG. 2;

FIG. 7 is a view similar to FIG. 5 illustrating a second embodiment of the orifice plate;

FIG. 8 is a view similar to FIG. 5 illustrating a third embodiment of the orifice plate;

FIG. 9 is a view similar to FIG. 5 illustrating a fourth embodiment of the orifice plate;

FIG. 10 is a view in partial cross-section illustrating a swirl body upstream of the orifice; and FIG. 11 is a view in partial cross-section of another embodiment of a swirl body.

DESCRIPTION OF THE PREFERRED EMBODIMENTS

Figure 4:
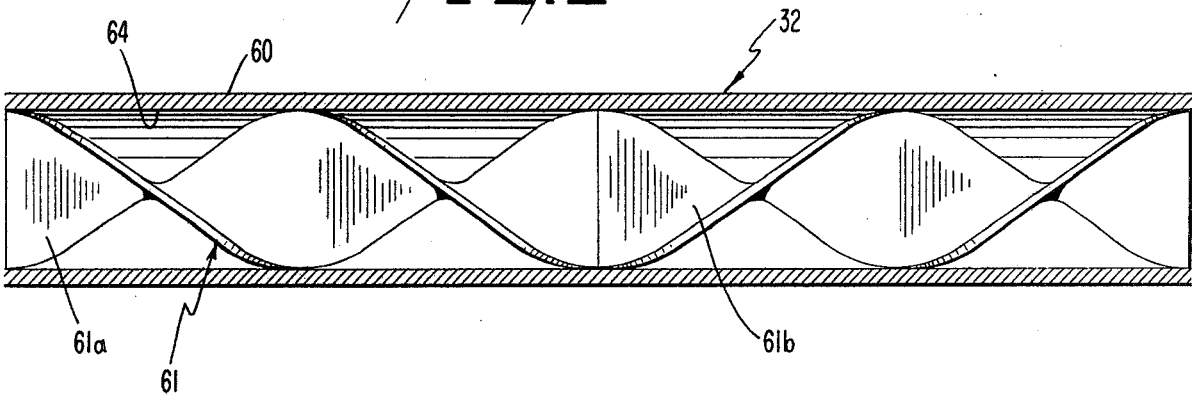
FIG. 4 is an enlarged view in longitudinal cross-section taken through the premixer of FIG. 1.

Turning now to FIG. 1, the preferred embodiment for the process according to the present invention is disclosed. A supply means includes a suitable supply conduit 20 that receives a multicomponent mixture or flow of at least one fluid stream and at least one substantially insoluble component. The supply means passes a current of a liquid stream and an insoluble component through an orifice in such a manner that a free turbulent shear layer is generated downstream of the orifice with cavitation occurring in that free turbulent shear layer and downstream of the opening. The supply means may include means for maintaining a predetermined pressure upstream of the orifice, means for maintaining a different predetermined pressure downstream of the orifice and a fluid supply means for maintaining a predetermined volumetric flow rate of fluid. The ensuing discussion will proceed on the assumption that one insoluble component and one fluid stream are present; however, multiple streams and/or multiple insoluble components are within the scope of the invention. In addition, the apparatus illustrated and referred to in the figures is illustrated for convenience in a horizontal posture but is equally effective in a vertical or inclined posture.

The supply conduit 20 supplies or feeds the multicomponent mixture to an homogenizing apparatus 21 having an homogenization chamber 22 in which the fluid stream and the substantially insoluble component are intimately mixed so as to produce an homogenized effluent which leaves the homogenizing chamber 22 by means of a discharge conduit 24.

Suitable liquid components for use as the fluid stream are water, hydrocarbon fuels and the like. Typical substantially insoluble components are liquids such as water, hydrocarbon fuels, particulate solids such as pulverized coal and the like. Where the insoluble component is a liquid, the resulting effluent is an emulsion having the fluid stream as the continuous portion and the liquid insoluble constitutent as the dispersed portion. Where the insoluble component is a particulate solid, the resulting effluent is a colloidal suspension in which the fluid stream is the continuous portion and the insoluble particulate solid is the dispersed portion.

While the present invention has utility in emulsifying hydrocarbon fuels and water for use as a fuel, there are numerous other potential uses. For example, when storage tanks of sea-going chemical tankers have been emptied, those tanks must be thoroughly washed before loading with another chemical substance. After use to clean the tank, the wash water with chemicals therein has been dumped overboard leading to intolerable pollution of the nearby sea water by the chemicals. By passing the wash water through the apparatus of the present invention, the chemical pollutants can be effectively dispersed to concentrations in the neighborhood of 1 part per million, a tolerable level. Such a procedure can be used with sea water as the wash water and any one of the following chemicals, it being understood that the list of chemicals is exemplary and is not intended as a limitation: acrylonitrile, carbon tetrachloride, chloroform, dichloroethyl ether, epichloro hydrin, phenol, toluene diisocyanate, aniline, benzene, cyclohexane, styrene monomer, and toluene.

The homogenized effluent from the discharge circuit 24 may be collected by a flow damping chamber or holding tank 26 for subsequent delivery through a feed conduit 28 to a utilization device 30.

Where the fluid stream is water and the substantially insoluble component is hydrocarbon fuel, or in the alternative, where water is the substantially insoluble component and hydrocarbon fuel is the fluid stream, the homogenized effluent is a fluid emulsion which may subsequently be used as fuel. Accordingly, the utilization device 30 may comprise an internal combustion engine 30 adapted to use the fluid homogenized effluent as a fuel.

As another alternative, the discharge conduit 24 may be connected directly to a homogenized effluent utilization device 30 such as the burner of a boiler without passing through a holding tank 26. Such an arrangement would be desirable where the burner operates continuously and requires a time-wise steady supply of fuel. With a boiler, the fuel might consist of a fuel/water emulsion or a coal/oil colloidal suspension.

To improve the efficiency of the homogenizing apparatus 21 and to minimize stratification of a horizontally flowing multicomponent mixture, a suitable conventional premixer 32 may be positioned upstream of the homogenizing chamber 22. The premixer 32 premixes the multicomponent mixture to provide more intimate association of the fluid stream and the substantially insoluble component. In so doing, the heterogeneous multicomponent mixture furnished to the homogenizer apparatus 22 consists of a more uniform distribution of the substantially insoluble component.

In the event that the multicomponent mixture supplied through the supply conduit 20 is not pressurized, the homogenizing apparatus 21 may include a suitable conventional pump 34 connected upstream of the homogenizing chamber 22 and upstream of the first premixer 32. The pump 34 is operable to pressurize the multicomponent mixture supplied to the chamber 22 so as to insure that necessary conditions of flow rate and pressure are attained to effect complete homogenization of the multicomponent mixture.

For an initial preconditioning step, the homogenization apparatus 21 may include a second premixer 36 positioned upstream of the pump 34 so as to premix the multicomponent mixture even before pressurization. In the foregoing manner, the multicomponent mixture of the fluid stream and the substantially insoluble component are first premixed by the second premixer 36, subsequently pressurized by the pump 34 such that the pressure level is raised to the neighborhood of 2,000 psig., again mixed by the first premixer 32, and then supplied to the homogenizing chamber 22 in which the multicomponent mixture is emulsified or turned into a colloidal suspension, depending on the nature of the insoluble constituent.

Downstream of the homogenization chamber 22 and upstream of the discharge conduit 24 is a suitable conventional valve 38 which is operable to regulate the downstream pressure sensed by the homogenization apparatus 22 and to regulate the volumetric flow rate of effluent therefrom.

When the discharge conduit 24 conveying the homogenized effluent is connected to a holding tank 26, a recirculation conduit 40 may be provided which communicates with the holding tank 26 and with the supply conduit 30 upstream of the premixer 36. This recirculation conduit 40 is operable to recycle a portion of the homogenized effluent from the holding tank 26 to the supply conduit 20 so that the volume of effluent in the holding tank 26 does not remain in the holding tank 26 for a time exceeding a separation half-life.

In comparing the relative efficiency and effectiveness of homogenizing systems, an homogenization coefficient is useful. The homogenization coefficient is defined as $K_e$ and is determined by the following relationship:

$$K_e = \frac{V_e - V_m}{V_t}$$

where $V_t$ is the total volume of the homogenized product; $V_m$ is the volume of the non-homogenized components; and, $V_e$ is the volume of the homogenized components. This homogenization coefficient has a maximum value of 1 which indicates complete homogenization.

As time progresses, some of the homogenized component separates into non-homogenized components, and, the value of the homogenization coefficient decreases accordingly. This dehomogenization or separation is a function, among other parameters, of the average size of particules or globules of the dispersed portion of the homogenized effluent: larger average sizes allow separation to occur relatively quickly, whereas smaller average sizes allow separation to occur relatively slowly. With this background, a separation half-life may be defined as the time required for the homogenization coefficient to decay to one-half of its initial value.

The recycling conduit 40 preferably is connected to the holding tank 26 to take the separated constituents of the homogenized effluent in preference to the still homogenized portion. Clearly, however, some of the homogenized portion will at times be recirculated and homogenized a second time.

The details of the homogenizing chamber 22 and the hydrodynamic mechanism whereby the homogenized effluent is created comprise an important part of the present invention. Turning now to FIG. 2, the homogenizing chamber 22 includes a conduit section 42 having a diameter, or characteristic dimension, D. The conduit 42 preferably is generally cylindrical in shape and may have a cross-section other than the circular cross-section depicted (see FIG. 3). Extending transversely of the conduit 42 and fixedly connected thereto is an orifice plate assembly 44 (FIG. 2) having a standard sharp-edged orifice opening 46 with a throat diameter, or characteristic dimension, *d*. The orifice opening 46 is preferably constructed according to the standard reference "Fluid Meters, Their Theory and Application" published by the American Society of Mechanical Engineers, New York, New York, which is incorporated herein by this reference thereto, and includes a beveled surface 49 which defines a sharp edge 47 that circumscribes the opening 46. In addition, the opening 46 is preferably concentric with the axis 51 of the conduit 42 so that the edge 47 is uniformly spaced therefrom. With the orifice opening constructed in accordance with known design characteristics for sharp-edged orifices, the flow characteristics of the sharp-edged orifice opening 46 are well defined in advance and the design of the homogenization chamber 22 is somewhat simplified.

The multicomponent mixture, comprising the liquid stream and the substantially insoluble component, flows from left to right in FIG. 2. Since the throat diameter *d* is small in comparison to conduit diameter D, a substantial increase in the fluid velocity occurs as the fluid passes through the sharp-edged orifice opening 46. A diameter quotient, defined as D/d, lies in the range of 5 to 75 and preferably between 10 and 50.

For a diameter quotient below 5, the lower limit, cavitation bubbles generated as fluid passes through the orifice opening 46 may get close to, or even impinge upon the internal wall of the conduit 22 and cause deleterious erosion thereof. Above a diameter quotient of 75 hydrodynamic loss becomes considerable and requires a pump 36 capable of developing substantially greater fluid pressure. As the cost of a pump is related to the pressure level it can generate, the upper limit of 75 for the diameter quotient may also have an economic influence on the apparatus. Still further, with a diameter quotient above the upper limit, the fluid velocity in the conduit 22 upstream of the orifice opening 46 may become so low that the fluid may freeze during use in low temperature environments, such as those which may exist during winter.

Within the range between the upper and lower limits, the diameter quotient, D/d, is determined by the required volumetric flow rate, the available pump output pressure, properties of the fluid, and a predetermined cavitation number, $\sigma$.

The cavitation number, $\sigma$, for the orifice opening is preferably selected to be greater than the cavitation inception number, $\sigma_i$, for the orifice opening. The cavitation number, $\sigma$, is a dimensionless parameter classically used in connection with cavitating flow regimes and is defined as follows:

$$\sigma = \left[ \frac{P_o - P_v}{\frac{1}{2}\rho V_o^2} \right]$$

where $P_o$ is the total pressure of the fluid downstream of the orifice opening 46; $P_v$ is the fluid vapor pressure; $\rho$ is the weighted average fluid density of the multicomponent flow; and $V_o$ is the average fluid velocity through the orifice. The cavitation inception number, $\sigma_i$, is an empirically determined quantity for a particular geometric configuration and is the threshold at which cavitation commences. By purposely selecting a diameter ratio and flow conditions so that the cavitation number $\sigma$ exceeds the cavitation inception number $\sigma_i$, cavitationally induced erosion of the orifice is essentially precluded.

As the fluid emerges from the downstream side of the orifice opening (the right side in FIG. 2), the fluid creates a submerged high velocity jet symmetrically extending along the conduit axis 51 and along the axis of the orifice opening. This high velocity jet is surrounded by a free turbulent velocity shear layer which is represented schematically by the divergent broken lines 50, 52. The lines 50, 52 in the drawing of FIG. 2 do not represent the actual boundaries of the free turbulent shear layer but are provided merely for illustrative purposes.

Within the free turbulent shear layer 48, a severe radial velocity gradient exists within the shear layer 50, 52 at the edge 47 of the opening. The severity of the velocity gradient diminishes moving downstream along the conduit axis 51 as the boundaries 50, 52 diverge and the velocity at the conduit axis 51 becomes smaller. The severe velocity gradient creates vorticity in the shear layer which is transported downstream by momentum of the fluid. In addition, a recirculating secondary flow exists in the vicinity of the orifice plate 44, schematically represented by arrows 54.

The large velocity gradient existing radially across the free turbulent shear layer and the vorticity generated thereby, cause development of a plurality of intense vortices **56*a*, 56*b*, 56*c*, 56*d*, 56*e*. The vortices 56*a* – *e*** may spread and dissipate as they move downstream, as depicted; but, new vortices are continually developed by virtue of the severe velocity gradient.

Within each vortex, which may be an annular ring, the fluid behaves in accordance with classical laws of fluid mechanics such that the fluid velocity increases toward the center of the vortex. This velocity increase causes a corresponding increase in dynamic fluid pressure and a comparable decrease in static fluid pressure. In fact, the static fluid pressure is reduced at the center of the vortex to a value below the vapor pressure of the fluid. Accordingly, small bubbles appear, grow, contract and implode in accordance with the classical phenomenon known as cavitation. These cavitation bubbles grow and move downstream in the fluid and subsequently enter the free stream portion of the flow. The pressure downstream of the orifice opening 46 is regulated by the valve 38 at a value such that the cavitation bubbles violently collapse.

The expression "violet collapse" is used herein to mean collapse with pressure in the range of 10,000 psi to 1,000,000 psi and preferably about 100,000 psi. For a collapse pressure below the lower limit of 10,000 psi, the bubble collapse generally does not generate good homogenization. On the other hand, for a collapse pressure greater than 1,000,000 psi, the pump 34 must have an inordinately high pressure capacity.

As the bubbles violently collapse, very strong pressure shocks propagate from each bubble and causes intimate intermixing between the fluid component and the substantially insoluble constituent such that the substantially insoluble constituent is broken up into very minute particles. Where the substantially insoluble component is a liquid, the resulting effluent from the homogenizing chamber 22 is an emulsion. Where, on the other hand, the substantially insoluble component is a finely divided solid substance, the implosion of the cavitation bubbles causes further subdivision and fracturing of the solid particles such that a colloidal suspension of those solid particles in the fluid stream results.

The following table gives one example of the operating conditions and results obtained therefrom with the present invention:

| | |
|---|---|
| Fluid | 50 volume percent water |
| Insoluble component | 50 volume percent No. 2 diesel fuel |
| Nominal conduit diameter | 0.375 inches |
| Orifice opening diameter | 0.010 inches |
| Pressure, upstream of orifice | 1000 psig |
| Pressure, downstream of orifice | 50 psig |
| Volumetric flow rate | 12 gallons per hour |
| Temperature | 70° F |
| Emulsification coefficient, $K_e$ | ~1.00 up to a half-life of 30–45 min. |
| Cavitation inception parameter, $\sigma_i$; | 0.014 |
| Cavitation number | 0.25 |

The optimum utilization of the cavitation bubble collapse in the present apparatus thus produces highly desirable results in terms of the resulting homogenization coefficient and the separation half-life. For example, the 50% - 50% concentration of diesel fuel in water can be homogenized with a homogenization coefficient close to unity. Separation half-lives have been recorded well above 500 minutes. By comparison, an ultrasonic homogenizer available in the commercial market would typically yield a homogenization coefficient less than 0.5 and a corresponding separation half-life on the order of 2 minutes. Thus, the proper use of the implosive energy of cavitation bubbles produces significantly better results both in homogenization coefficient and in separation half-life.

The valve 38 depicted in FIG. 1, is employed to control the static pressure existing on the downstream side of the orifice plate 44. It is noted that the cavitation bubbles existing in the zone between the orifice plate 44 and the valve 38 create an atypical phenomenon when dealing with normally incompressible fluids: the presence of the cavitation bubbles allows the downstream pressure to be regulated by the back pressure valve 38 but the back pressure is not fully communicated upstream through the orifice opening 46 of the homogenizing chamber 22. This phenomenon is somewhat analogous to that experienced with shock waves in supersonic compressible flow.

The axially symmetric chamber 22 allows the free turbulent velocity shear layer along with the homogenizing cavitation bubbles to be uniformly spaced from the inner surface of the conduit 42. Since the deleterious effects of implosion of cavitation bubbles is substantially nonexistent at a distance of approximately twice the bubble diameter preceding implosion, and since the bubbles always have small diameters in comparison to spacing from the conduit wall, the conduit wall 42 is not in the zone of action of the cavitation bubbles, and therefore, is not adversely affected by the cavitation bubbles, a sharp contrast to known prior art devices.

Figure 5:
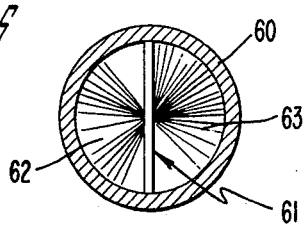
FIG. 5 is an end elevaton of the premixer of FIG. 4.

Turning now to FIG. 4, one embodiment of a premixing device is disclosed which may be used as the premixing chamber 32 and/or the premixing chamber 36. More particularly, as illustrated, a substantially circularly cylindrical conduit section 60 has an internal surface 64. A longitudinally extending helically twisted element 61 is suitably attached to the inner surface 64 and defines a pair of channels 62, 63 (see FIG. 5).

The twisted element 61 has a first portion 61*a* which twists in a right hand spiral and a second portion 61*b* which twists in a left hand spiral. The first and second portions 61*a*, 61*b* may be integral or in abutment with one another, as desired. To minimize restriction of the conduit 60, the twisted element has a small thickness *t* in comparison to the nominal diameter D, of the conduit. Preferably, the quotient of *t* divided by D is no greater than 0.1. An adequate amount of mixing has been found to result when the pitch of the twisted element 61 is about 4 times the nominal conduit diameter D.

The multicomponent mixture flows through the premixer 32 with a portion passing through each of the channels 62, 63. In this fashion, the flow in each channel is constrained and develops eddies while passing the first portion 61*a* and different eddies while passing the second, oppositely rotated portion 61*b* to promote mixing of the insoluble constituent with the through flow material.

The downstream end 68 of the conduit 60 (also the end of the premixer 32) is preferably positioned within 20 orifice throat diameters *d* of the orifice plate 44 of the homogenizing apparatus 22 (see FIG. 2). In this manner, there is essentially no opportunity for the mixture effected by the premixer 32 to stratify or separate before entering the homogenizing chamber 22.

Figure 6:
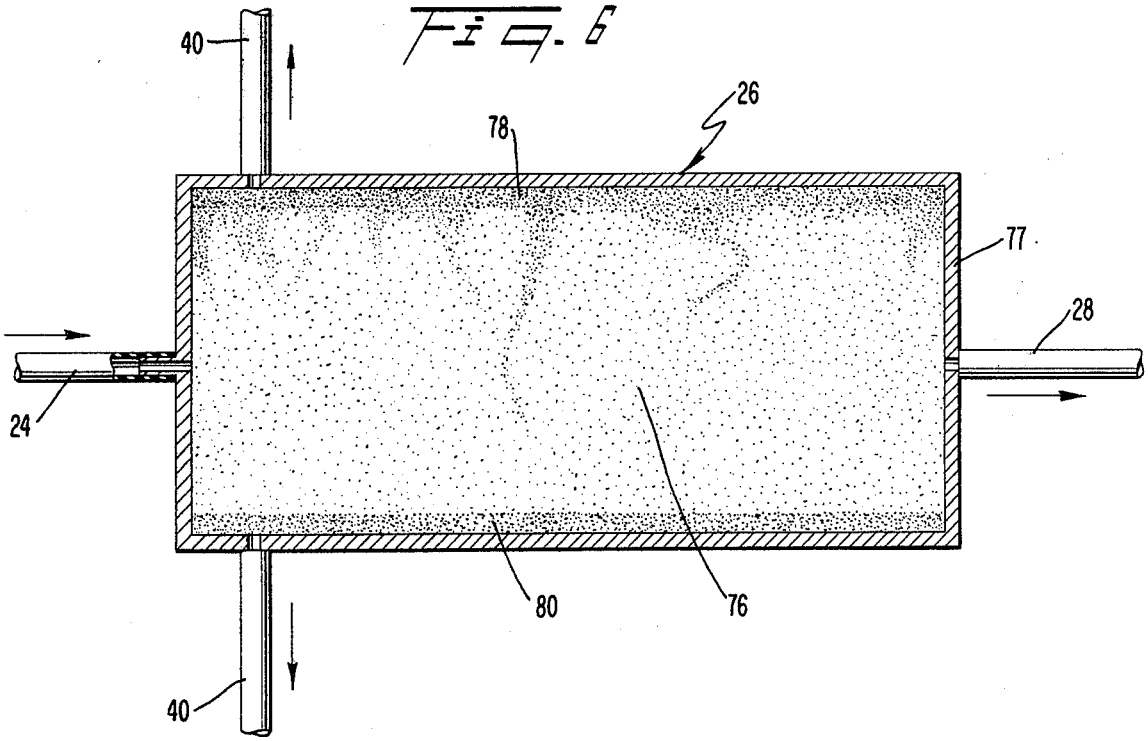
FIG. 6 is an enlarged longitudinal cross-section taken through the holding tank of FIG. 1.

Turning now to FIG. 6, the holding tank 26 is depicted in which the homogenized effluent from the homogenizing chamber 22 may be collected. The effluent accumulates in the holding tank 26 such that the homogenized portion 76 is positioned substantially in a central region 76 while one component 78, the lighter one, floats on the homogenized portion 76 and a second component 80, the heavier one, underlies the homogenized portion 76. The feed conduit 28 is positioned substantially at the vertical midpoint of a tank wall 77 to communicate with the homogenized portion 76. The recirculating conduit 40 communicates with the lower component 80 as well as the upper component 78 and is operative to preferentially draw off these portions of the fluid in the holding tank 26 in preference to the homogenized portion 76.

The size of the holding tank 26 is designed according to the end use of the homogenizer. More particularly, if the flow rate from the homogenizer is equal to the consumption, then there is no need for a holding tank. However, in many applications the consumption may at times be as low as 50 percent of the homogenizer output. The remaining 50 percent of the homogenizer output will then be stored in the holding tank and recirculated through the homogenizer. The volume of emulsion thus stored, and hence the volumetric capacity of the holding tank 26, depends upon the response time of the end use device. Generally, the common use involves an engine whose response time may be at the most 5 minutes for acceleration and deceleration purposes. Thus, the holding tank would be sized to store about a 5 minute output of the homogenizer. The particular application may suggest desirable variations to improve matching the homogenizer output and holding tank characteristics.

While the present invention has been disclosed with a sharp-edged orifice opening 46 which is the preferred embodiment, other embodiments of the orifice opening are within the contemplation of the present invention. For example, (see FIG. 7) an orifice plate 90 may be provided with two substantially semi-circular orifice openings 92, 94 having a concentrically located generally circular plate 96. The plate 96 is positioned by a pair of straps 98 connected to the orifice plate 90.

In a third embodiment of the orifice plate (FIG. 8), a circular orifice plate 100 may be provided with a substantially square orifice opening 102 which is sharp-edged and has its mid-point concentric with the longitudinal axis of the homogenizing chamber.

In a fourth embodiment of the orifice plate (FIG. 9), an orifice plate 106 is provided with a substantially circular opening 108 which is blunt in cross-section and does not have the sharp-edge disclosed in the embodiment of FIG. 2.

If desired, the mixed flow of the fluid and the substantially insoluble component may be provided with a swirling motion before passing through the orifice plate 44. For example, a generally cylindrical swirler body 116 (see FIG. 10) may be fixedly positioned in the conduit 42 upstream of the orifice plate. The swirler body is preferably provided with a generally helical channel 118 in the surface 120 thereof through which the mixture flows.

In another embodiment (see FIG. 11), a swirler body 122 may be provided which is rotationally symmetric about the conduit axis. An insert 124 preferably is positioned in the conduit 42 with an internal surface 126 contoured to match the external surface 128 of the swirler body 122. A generally helical channel 130 is provided in the surface 128 to generate swirling flow through the orifice opening 46. To fixedly position the swirler body 122, suitable struts 132 may be provided at desired locations. With this embodiment, an annular channel 134 is provided between the swirler 122 and the conduit 42 as well as between the swirler 122 and the insert 124.

To the extent that various fluids are to be used in the homogenization apparatus, the scaling of various properties including cavitation parameters may be necessary. Guidelines for such scaling are presented in "Scaling Laws of Cavitation Erosion", by A. Thiruvengadam, a paper presented at the Symposium on Flow of Water at High Speeds, Leningrad, U.S.S.R., June 1971 and in "The Role of Physical Properties of Liquids in Cavitation Erosion" by Sung Tung and A. Thiruvengadam, a paper presented in the Proceedings of the Southeastern Conference on Theoretical and Applied Mechanics, Washington, D.C., 1974, both of which are incorporated herein by this reference thereto.

In operation, a multicomponent stream including a liquid and at least one substantially insoluble component mixed therewith is fed to the homogenizing apparatus of FIG. 1 through the conduit 20. The multicomponent stream is premixed in the mixer 36 so as to provide a general uniform distribution of the substantially insoluble component in the liquid.

The mixture is then pressurized by passing through the pump 34. The pressurized mixture subsequently enters a second mixer 32 where it is mixed another time to improve the homogeneity thereof. The multicomponent stream is then fed into the homogenizing apparatus 22. Pressure of the multicomponent stream entering the homogenization chamber 22 is maintained at a first pressure level by the pump 34.

Within the homogenization chamber 22, see FIG. 2, a free turbulent shear layer 48 is created by passing the multicomponent stream through the orifice opening 46. Within the free turbulent shear layer a cavitating flow regime develops downstream of the orifice opening 46 having a multiplicity of bubbles. The cavitating flow with bubbles is created in part by maintaining the downstream pressure at a second pressure level by appropriate adjustment of the valve 38. Preferably, the first pressure level is maintained between 10 and 100 times the second pressure level.

The second pressure level to which the free turubulent shear layer is exposed caused violent collapse of the bubbles thereby generating a homogenized effluent of the liquid and the insoluble component. The homogenized effluent may be collected in a chamber 26 which damps the effect of a variable flow rate demand. If desired, a portion of the homogenized effluent from the damping chamber may be recycled to the inlet o the first premixer in order to insure that separated constituents of the homogenzied effluent are again suitably treated.

The multicomponent flow provided to the conduit 20 may be effected by supplying any suitable liquid and by supplying any suitable substantially insoluble component to the conduit 20.

It should now be apparent that with a process and apparatus for emulsification or collodial suspension of a component within a fluid component by the process and apparatus disclosed herein, there is no mechanical erosion which will deleteriously affect the homogenizing apparatus.

It will now be apparent to those skilled in the art that the vortices generated by the free turbulent velocity shear layer are advantageously used in the present invention to develop a cavitating flow in which the imploding bubbles effect improved intermixing of the substantially insoluble components.

Moreover, the present invention generates a product with an excellent separation half-life which results in an emulsion or colloidal suspension that can be stored for useful periods of time.

In addition, the present invention provides an on-line apparatus which can be connected with a utilization device to provide continuous operation.

And, in addition, the apparatus of this invention is uniquely adapted to be substantially unaffected by the implosion of cavitation bubbles.

It should now be apparent that there has been provided in accordance with the present invention, a novel process and apparatus for emulsifying and colloidally suspending a mixture of a fluid and a substantially insoluble component which substantially satisfies the objects and advantages set forth above. Moreover, it will be apparent to those skilled in the art that many modifications, variations, substitutions and equivalents for the features described above may be effected without departing from the spirit and scope of the invention. Accordingly, it is expressly intended that all such modifications, variations, substitutions and equivalents which fall within the spirit and scope of the invention as defined in the appended claims be embraced thereby.

What is claimed is:

1. A process of homogenizing a liquid and an insoluble component comprising the steps of:

feeding a multicomponent stream including a liquid and at least one insoluble component mixed therein, the stream having a first pressure, $p_0$;

creating in the multicomponent stream a free turbulent shear layer;

allowing a cavitating flow regime with bubbles to develop in the free turbulent shear layer; and exposing the free turbulent shear layer to a sufficiently high pressure, $P_1$, where $10 \leqq (p_0/(p_1)(P1) \leqq 100$ to violently collapse the bubbles and generate a homogenized effluent of the liquid and the insoluble component.

2. A process of homogenizing a liquid and an insoluble component comprising the steps of:

feeding a multicomponent stream including a liquid and at least one insoluble component mixed therein;

creating a free turbulent shear layer in the multicomponent stream having a cavitating flow regime with bubbles therein;

exposing the free turbulent shear layer to a sufficiently high pressure to violently collapse the bubbles and generate a homogenized effluent of the liquid and the insoluble component;

premixing the liquid and the insoluble component to provide a mixed multicomponent flow; pressurizing the mixed multicomponent flow; and mixing the mixed multicomponent flow a second time by passing the mixed multicomponent flow through a mixer preparatory to the feeding step.

3. The homogenizing process of claim 3 further including the step of premixing the liquid and the insoluble component before the feeding step to reduce stratification therebetween.

4. The homogenizing process of claim 3 further including the step of collecting the homogenized effluent in a damping chamber to effect a supply of effluent that satisfies a variable flow rate demand.

5. The homogenizing process of claim 4 further including the step of recirculating a portion of the homogenized effluent from the damping chamber so as to recycle separated fluid and insoluble component.

6. The homogenizing process of claim 4 further including the steps of:

determining the separation half-life of the effluent; and regulating the rate at which effluent is supplied to the damping chamber so that the volume of effluent in the damping chamber is supplied once during each separation half-life of the effluent.

7. A process of homogenizing a liquid and an insoluble component comprising the steps of:

feeding a multicomponent stream including a liquid and at least one insoluble component mixed therein;

creating a free turbulent shear layer in the multicomponent stream having cavitating flow regime with bubbles therein;

exposing the free turbulent shear layer to a sufficiently high pressure to violently collapse the bubbles and generate a homogenized effluent of the liquid and the insoluble component;

maintaining a first pressure in the multicomponent stream during the feeding step;

maintaining a second pressure in the homogenized effluent downstream of the turbulent shear layer; and maintaining the ratio of the first pressure to the second pressure in the range of 10 to 100.

8. The homogenizing process of claim 7 wherein the feeding step includes the steps of:

supplying a fuel oil stream as the liquid; and supplying pulverized coal as the insoluble component.

9. The homogenizing process of claim 7 wherein the feeding step includes the steps of:

supplying a water stream as the liquid; and supplying a hydrocarbon fuel as the insoluble component.

10. The homogenizing process of claim 7 wherein the feeding step includes the steps of:

supplying a hydrocarbon fuel stream as the liquid; and supplying a water stream as the insoluble component.

11. The homogenizing process of claim 7 wherein the feeding step includes the steps of:

supplying a water stream as the liquid; and supplying lubricating oil as the insoluble component.

12. The homogenizing process of claim 7 wherein the feeding step includes the steps of:

supplying a water stream as the liquid; and supplying a chemical as the insoluble component.

13. The homogenizing process of claim 7 wherein the creating step includes the steps of:

conducting the liquid stream into a conduit having an orifice;

passing the liquid stream through the orifice at a sufficiently high velocity to create a fluid jet downstream of the orifice that is surrounded by the turbulent shear layer; and inducing vortices in the turbulent shear layer in which local pressure is reduced below vapor pressure of the liquid stream so as to create the bubbles.

14. Apparatus for generating an homogenized effluent from a liquid stream and an insoluble component such that the effluent has a separation half-life substantially greater than a few minutes comprising:

orifice means having an opening therethrough, including a conduit having an inlet for receiving the liquid stream and the insoluble component and an exit for discharging an homogenized effluent, and an orifice plate positioned transversely in the conduit between the inlet and the exit and being provided with the opening;

supply means for passing a current containing a liquid stream and an insoluble component through the opening and operable to maintain a a pressure $p_0$ upstream of the orifice means and a pressure $p_l$ downstream of the orifice means such that $10 \leqq (p_0)/(p_1) \leqq 100$ so as to generate a free turbulent shear layer downstream of the opening with cavitation occurring in said free turbulent shear layer; wherein the conduit has a first characteristic transverse dimension, D, the orifice plate opening has a second characteristic transverse dimension, d, and the second characteristic dimension is related to the first characteristic dimension such that $5 \leqq D/d \leqq 75$.

15. The homogenizing apparatus of claim 14 wherein the opening is circular.

16. The homogenizing apparatus of claim 14 wherein the opening is annular.

17. The homogenizing apparatus of claim 14 wherein the orifice means is provided with a swirl generator which terminates at the opening and is operable to create a spirally flowing current of the liquid stream and the insoluble component.

18. The homogenizing apparatus of claim 14 wherein the orifice plate comprises a standard sharp-edged orifice plate.

19. The homogenizing apparatus of claim 14 wherein the second characteristic dimension is related to the first characteristic dimension such that $10 \leqq D/d \leqq 50$.

20. Apparatus for homogenizing a liquid stream and an insoluble component to generate an effluent that has a separation half-life substantially greater than a few minutes comprising:

orifice means having an opening therethrough;

supply means for passing a current containing a liquid stream and an insoluble component through the opening and operable to generate a free turbulent shear layer downstream of the opening which causes cavitation to occur in said free turbulent shear layer, the cavitation being confined downstream of the opening;

wherein the orifice includes a conduit having an inlet for receiving the liquid stream and the insoluble component and an exit for discharging an homogenized effluent, and an orifice plate positioned transversely in the conduit between the inlet and the exit, the orifice plate having an orifice plate opening;

the conduit has a first characteristic transverse dimension, D;

the orifice plate opening has a second characteristic transverse dimension, d where $5 \leqq D/d \leqq 75$; and wherein the supply means includes first means for maintaining a first predetermined pressure; $p_0$, upstream of the orifice means, second means for maintaining a second predetermined pressure; $p_1$, downstream of the orifice means so that $10 \leqq (p_0)/(p_1)$ 100 and fluid supply means for maintaining a predetermined volumetric flow rate of the liquid stream.

21. Apparatus for homogenizing a liquid stream and an insoluble component to generate an effluent that has a separation half-life substantially greater than a few minutes comprising:

orifice means having an opening therethrough;

supply means for passing a current containing a liquid stream and an insoluble component through the opening and operable to generate a free turbulent shear layer downstream of the opening which causes cavitation to occur in said free turbulent shear layer, the cavitation being confined downstream of the opening;

the opening has a characteristic dimension, d; and supply means including a first premixing means positioned upstream of the opening, spaced therefrom by a length which lies in the range of 20 to 100 times the characteristic dimension, *d*, and being operable to coarsely intermix the insoluble component with the liquid stream so as to avoid a startified flow.

22. The homogenizing apparatus of claim 21 wherein the first premixing means includes a spirally arranged mixing passage.

23. The homogenizing apparatus of claim 21 wherein the supply means further includes:

second premixing means positioned upstream of the first premixing means; and fluid pressurizing means for developing a first pressure $p_0$in the liquid stream, the pressurizing means being positioned between the first and second premixing means.

24. The homogenizing apparatus of claim 23 further including:

means for establishing a second pressure, $p_1$, in the fluid stream downstream of the orifice means, such that $10 \leqq (p_0/(p_1) \leqq 100$.

25. The homogenizing apparatus of claim 24 wherein $10 \leqq (p_0)/(p_1) \leqq 30$ for diesel fuel and water.

26. Apparatus for homogenizing a liquid stream and an insoluble component and for supplying the resulting homogenized effluent to a device requiring a varying supply of the effluent comprising:

orifice means having an opening therethrough and providing a predetermined flow restriction;

supply means for passing a current containing a liquid stream and an insoluble component through the opening, operable to maintain a predetermined pressure ratio across the opening, and operable to generate a free turbulent shear layer downstream of the opening with cavitation occurring in the free turbulent shear layer downstream of the opening so as to produce a homogenized effluent at a predetermined flow rate; and tank means downstream of the supply means, operable to receive the homogenized effluent at the predetermined flow rate, connected to supply the homogenized effluent to a device requiring a varying flow rate, the tank means having a volume selected such that homogenized effluent not used by the varying flow rate can be stored in the tank means for later use, the effluent being used within its separation half-life.

27. The homogenizing apparatus of claim 26 including a recirculation means connected with the tank means, communicating with the supply means upstream of the orifice means and operable to recycle that portion of the effluent which includes separated fluid and insoluble component.

28. Apparatus for generating an homogenized effluent from a liquid stream and an insoluble component such that the effluent has a separation half-life substantially greater than a few minutes comprising:

a source of a liquid stream;

a source of a component insoluble in the liquid stream;

means for locally accelerating the fluid stream, having an opening that provides a predetermined restriction to the fluid stream;

means for delivering a current containing the liquid stream and the insoluble component to the means for accelerating, including means for establishing a predetermined pressure quotient across the means for accelerating, the predetermined restriction and the predetermined pressure quotient selected to generate a free turbulent shear layer in said stream downstream of the opening with cavitation occurring in said free turbulent shear layer downstream of the opening, the predetermined pressure quotient and the predetermined restriction causing cavitation bubbles to collapse with a collapse pressure in the range of 10,000 to 1,000,000 psi.

* * * * *